US006318136B1

(12) United States Patent
Mauer

(10) Patent No.: US 6,318,136 B1
(45) Date of Patent: Nov. 20, 2001

(54) ELECTROMAGNETICALLY CONTROLLABLE SAFETY LOCK

(75) Inventor: Gunter Mauer, Heiligenhaus (DE)

(73) Assignee: Mauer GmbH, Heiligenhaus (DE)

( * ) Notice: Subject to any disclaimer, the term of this patent is extended or adjusted under 35 U.S.C. 154(b) by 0 days.

(21) Appl. No.: 09/446,858

(22) PCT Filed: Jan. 29, 1999

(86) PCT No.: PCT/DE99/00238

§ 371 Date: Dec. 28, 1999

§ 102(e) Date: Dec. 28, 1999

(87) PCT Pub. No.: WO99/39065

PCT Pub. Date: Aug. 5, 1999

(30) Foreign Application Priority Data

Jan. 30, 1998 (DE) ..... 198 03 648

(51) Int. Cl.[7] ..... E05B 47/06

(52) U.S. Cl. ..... 70/276; 70/277; 70/278.6; 70/278.7; 70/283; 70/292; 70/144; 70/251.5

(58) Field of Search ..... 70/276, 277, 432, 70/283, 278.5, 278.6, 278.7; 292/144, 251.5

(56) References Cited

U.S. PATENT DOCUMENTS 4,984,441 * 1/1991 Mauer ..... 70/277

FOREIGN PATENT DOCUMENTS

0228027 * 7/1987 (EP) .
0427188 * 5/1991 (EP) .
0429712 * 6/1991 (EP) .
0819813 * 1/1998 (EP) .
2635554 * 2/1990 (FR) .

* cited by examiner

*Primary Examiner*—Lloyd A. Gall
(74) *Attorney, Agent, or Firm*—Edwin D. Schindler

(57) ABSTRACT

An electromagnetically controllable safety lock includes a locking bar which moves a slider, which is provided with teeth and which carries a blocking plate equipped with a passage pin channel. The blocking plate is coupled via a spring to a control plate, which has an angularly offset passage pin channel. The control plate supports an armature, which can be held by an electromagnet, fixed to the housing when the locking bar is subjected to a control movement. Both channels are aligned with the lock axis during an opening action so that the passage pin has a free path.

9 Claims, 12 Drawing Sheets

ELECTROMAGNETICALLY CONTROLLABLE SAFETY LOCK

CROSS-REFERENCES TO RELATED APPLICATION

This represents the U.S. National Phase, pursuant to 35 U.S.C. §371, of P.C.T. Application No. PCT/DE99/00238, filed Jan. 29, 1999.

BACKGROUND OF THE INVENTION

1. Technical Field of the Invention

The invention relates to an electromagnetically controllable safety lock with a locking bar having a passage pin, and with an electromagnet acting as a retaining magnet, said electromagnet blocking or releasing the retraction of the locking bar.

2. Description of the Prior Art

Such a lock has become known from EP 0 427 188. The electromagnetically controlled lock for safe deposit boxes described therein has an electromagnet secured in the housing, faced by an armature supported on a locking lever. The locking lever, shaped in a complex way, is coupled with a control lever via a supporting pin, control came and a spring, said control lever having a passage pin channel. Furthermore, provision is made for a locking slide, which supports a passage pin engaging the control lever. Blockage and release by swivel motions require exact interaction between retaining magnetic forces, control cams, control pins, supporting pins, springs and the passage pin. The components may have hardly any play or wear, otherwise failure is caused by tilting. EP 0 228 027 concerns an electromagnetically controlled lock for safe deposit boxes as well, in a housing, where a bank lock mechanism is accommodated in the front-side opening of said housing in addition to the lock for the customer. An electromagnet is accommodated in a rear-side recess of the housing. A locking lever and a control lever are arranged below the main locking bar and are therefore relatively difficult to access. The locking lever supports a magnetic armature opposing the yoke of said electromagnet. In the present case, too, exact interaction between the magnet, the control and locking levers and the passage pin is important, whereby close manufacturing tolerances have to be maintained in order to assure flawless functioning in the long run.

SUMMARY OF THE INVENTION

The invention is based on the problem of improving a lock with the features specified above in such a way that it can do with elements that can be manufactured in a simple way; that it is operationally reliable; and that it can be employed in many different ways. According to the invention, the locking bar moves a slider provided with teeth, said slider driving a blocking plate provided with a passage pin channel.

Furthermore, said blocking plate is coupled via a spring with a control plate having an angularly offset passage pin channel. The control plate supports an armature, which is retained by the electromagnet when the latter is live, which causes both channels to be aligned with the axis of the lock and to permit the passage pin to pass.

The novel type of lock with swiveling blocking and controlling elements can basically be employed in two variations: in configuration A, it receives a normal, heavy locking bar, which is moved by means of a handle via a driving nut. With configuration B, provision is made only for an auxiliary locking bar provided with a driving pin.

The driving pin engages in the locking bar of a main lock, which may be designed in the form of a double-bit lock or combination lock. The combination permits the "four eyes principle" for increasing the safety.

The elements required for controlling the lock are identical in the two configurations. In a preferred form of embodiment, the risk of blocking the lock is substantially reduced in that provision is made for two identical electromagnets, which can be controlled selectively.

DESCRIPTION OF THE DRAWINGS FIGURES

Configuration A of the invention is explained with the help of FIGS. 1 to 13 of the drawings. Another type of embodiment is described in FIGS. 14 to 20.

Figure 5C:
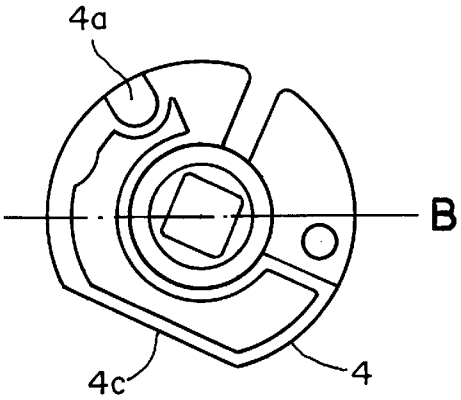
Figure 5B:
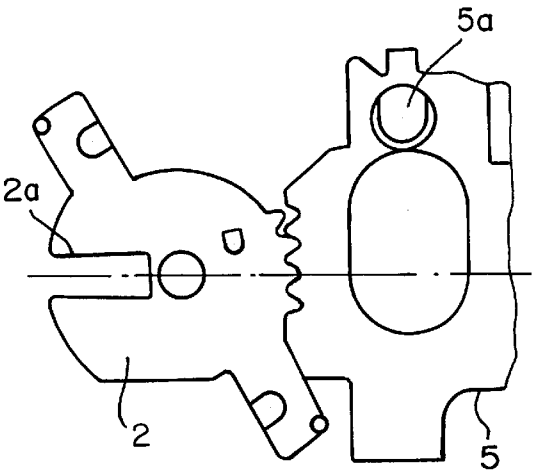
Figure 5A:
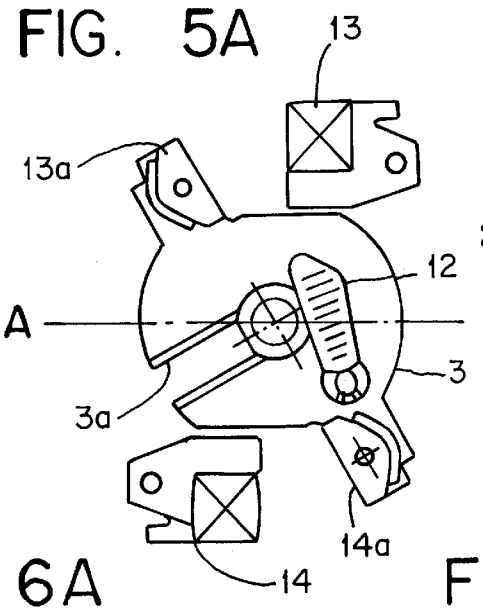

FIGS. 5*a*, 5*b*, 5*c* show the control elements in the blocking phase.

Figure 6C:
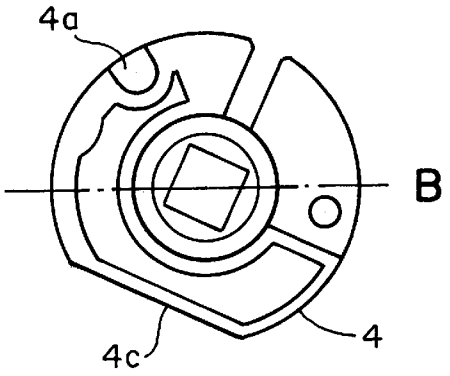
Figure 6B:
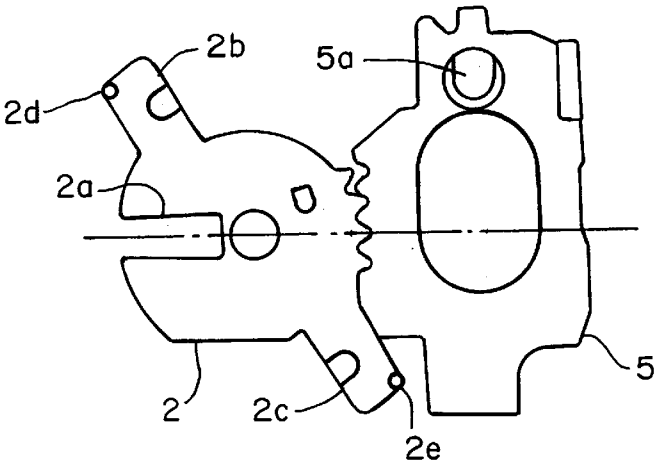
Figure 6A:
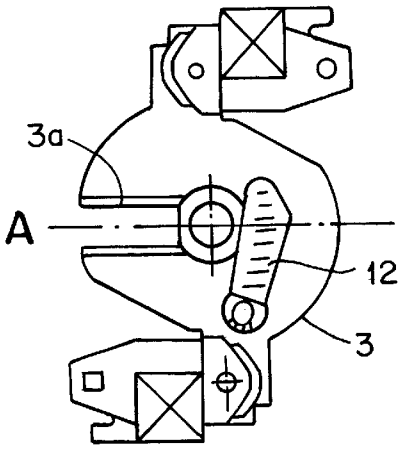

FIGS. 6*a*, 6*b*, 6*c* show said elements in the opening phase.

Figure 7:
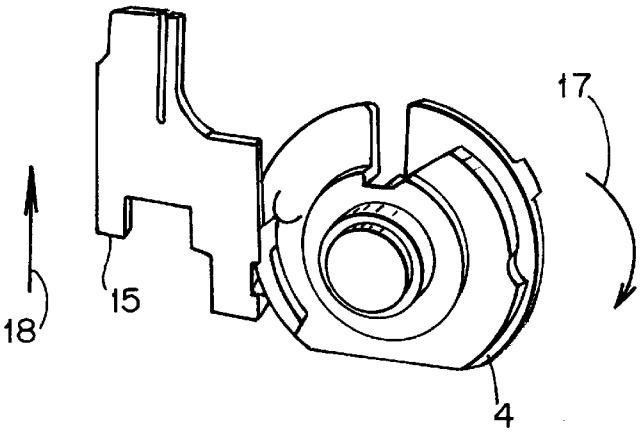

FIG. 7 shows the driving nut with a switching slide.

Figure 8:
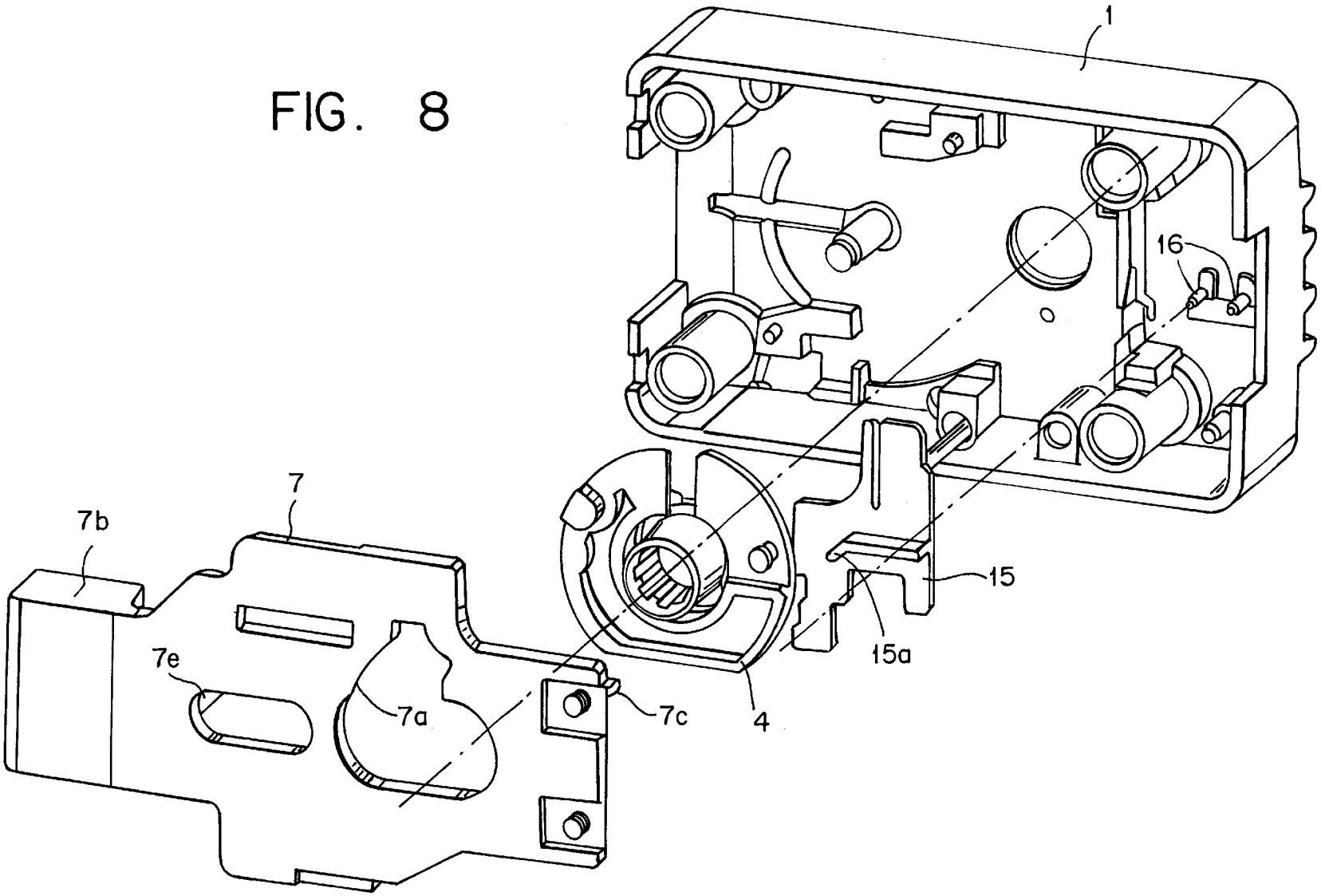

FIG. 8 is a perspective view of the housing, the driving nut and the locking bar.

Figure 9:
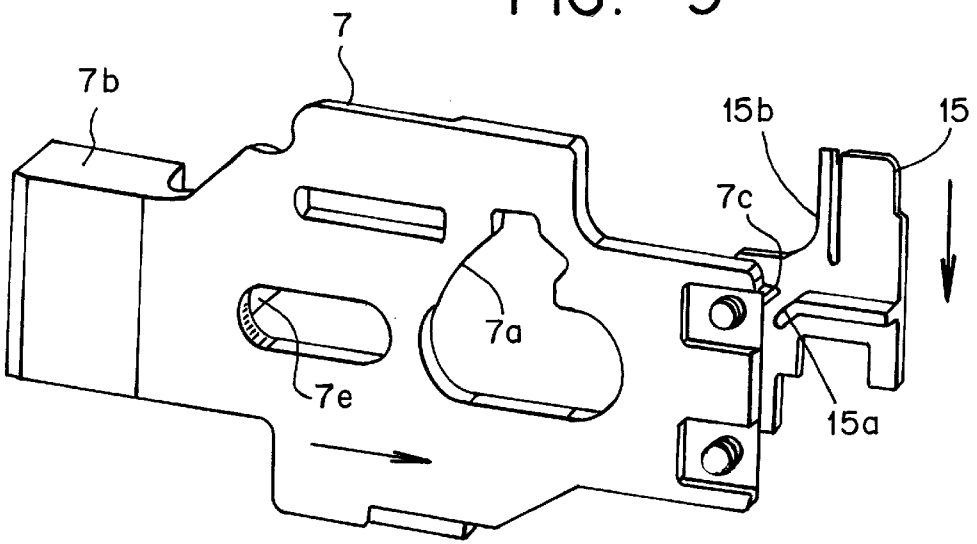

FIG. 9 shows the locking bar and a switching slide actuated by said locking bar.

Figure 10:
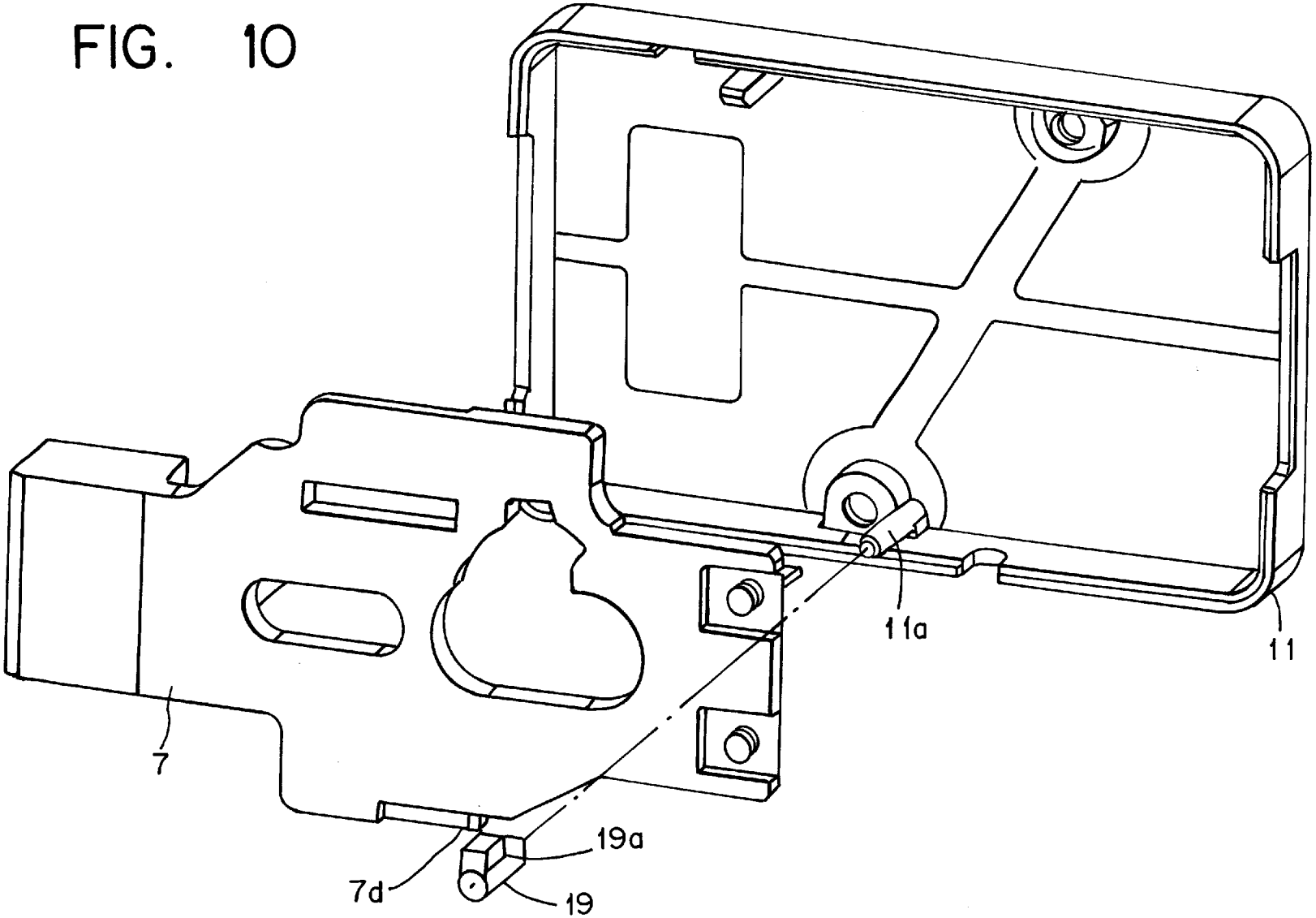

FIG. 10 is a perspective view of components of a re-locking system.

Figure 13:
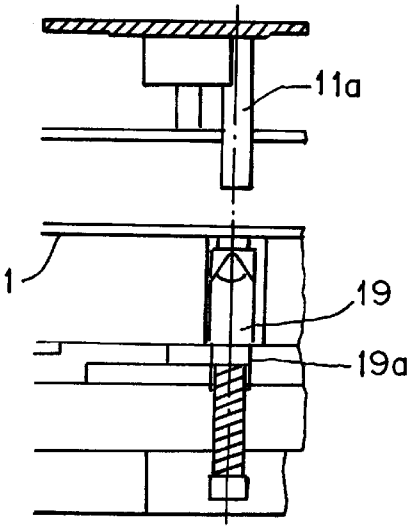
Figure 12:
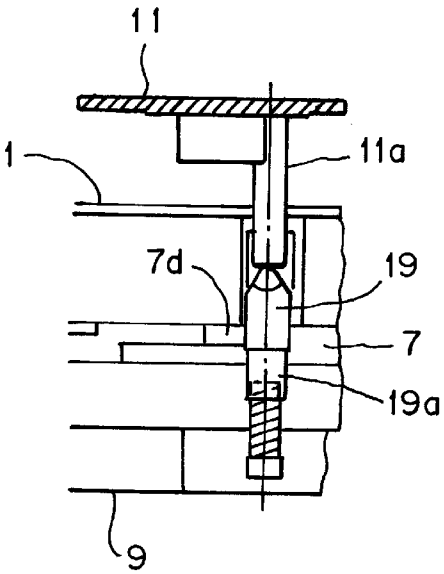
Figure 11:
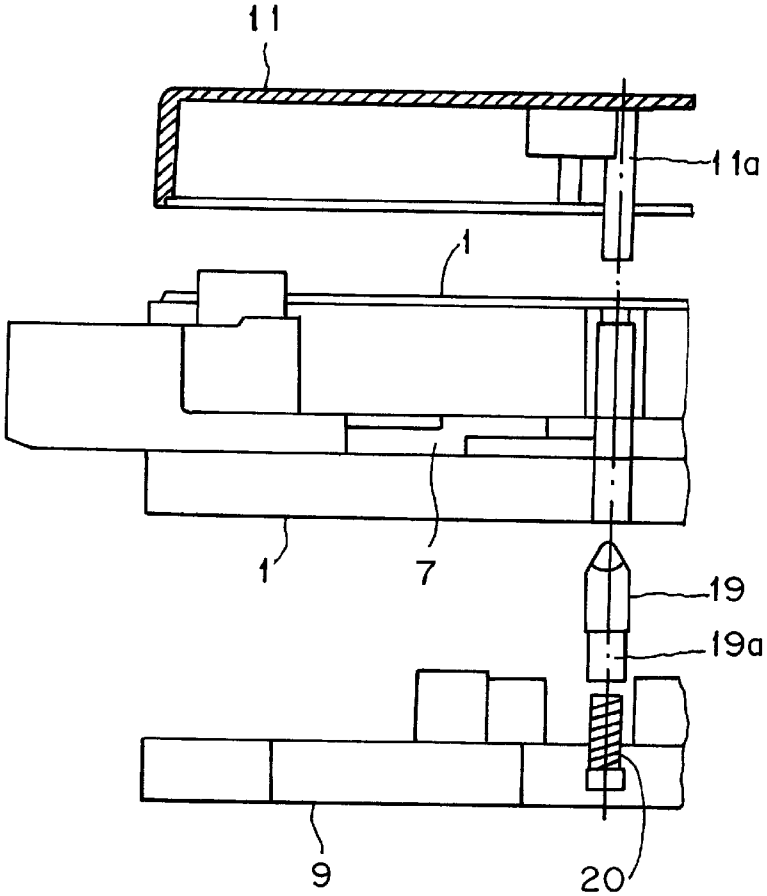

FIGS. 11, 12, 13 show longitudinal sections of the re-locking system in various conditions.

Figure 14:
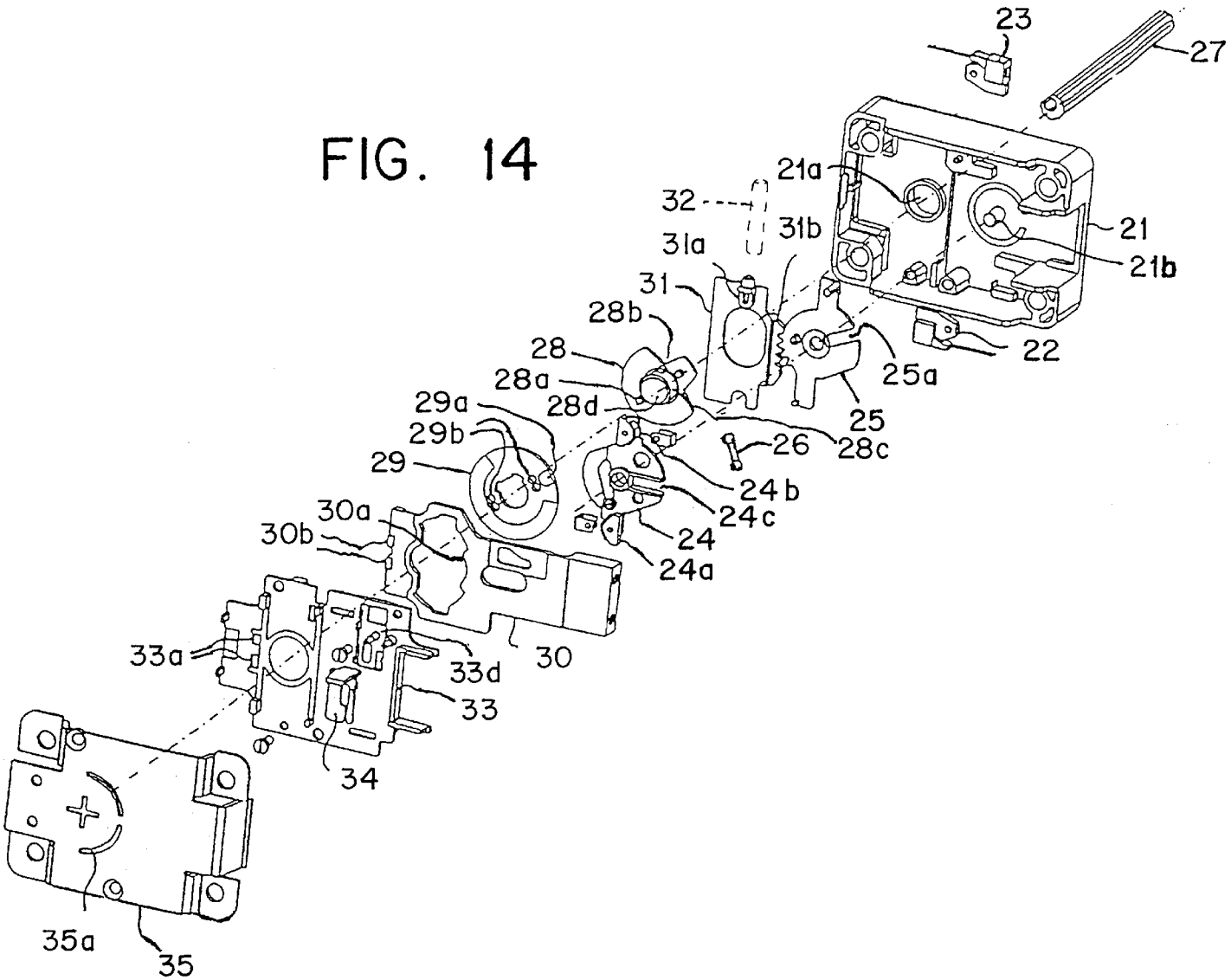

FIG. 14 shows another embodiment in an exploded view.

Figure 15:
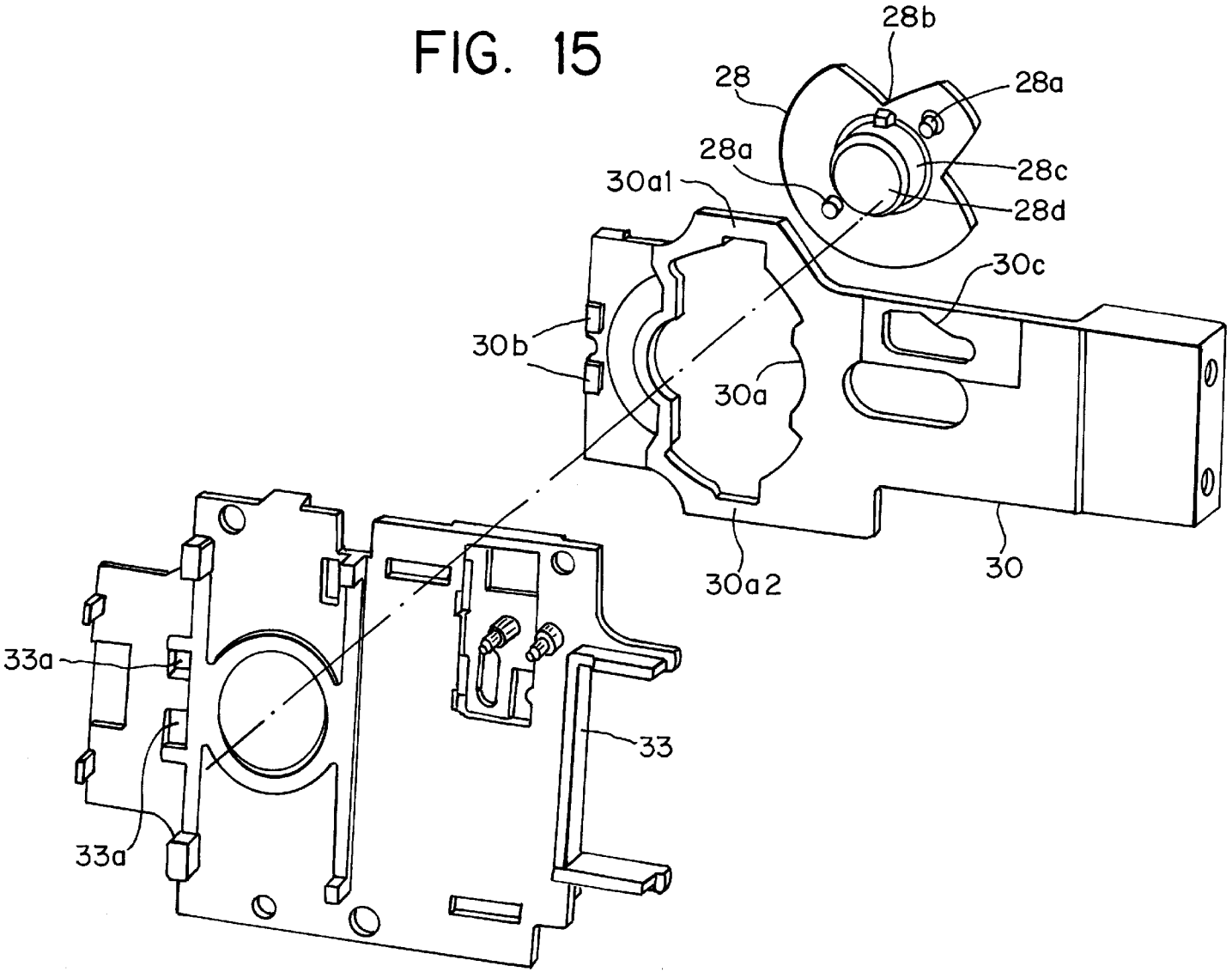

FIG. 15 shows certain individual components by the same representation.

Figure 16:
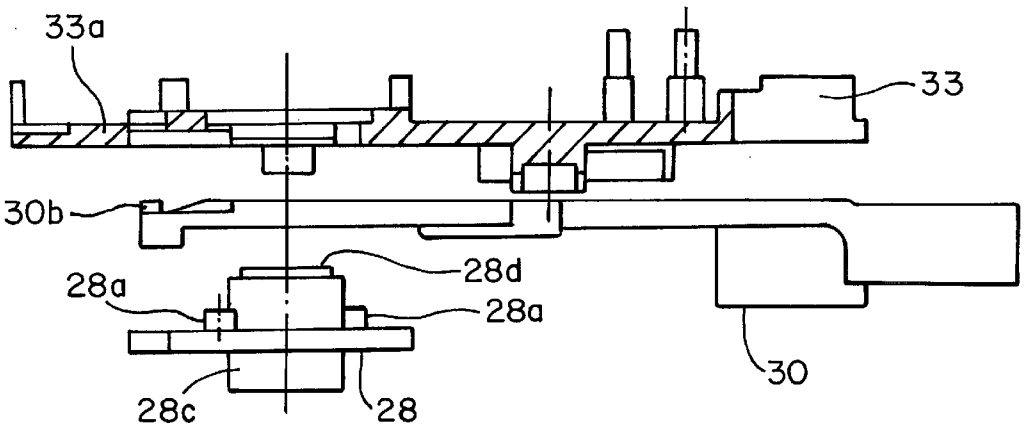

FIG. 16 is a top view of said components.

Figure 17:
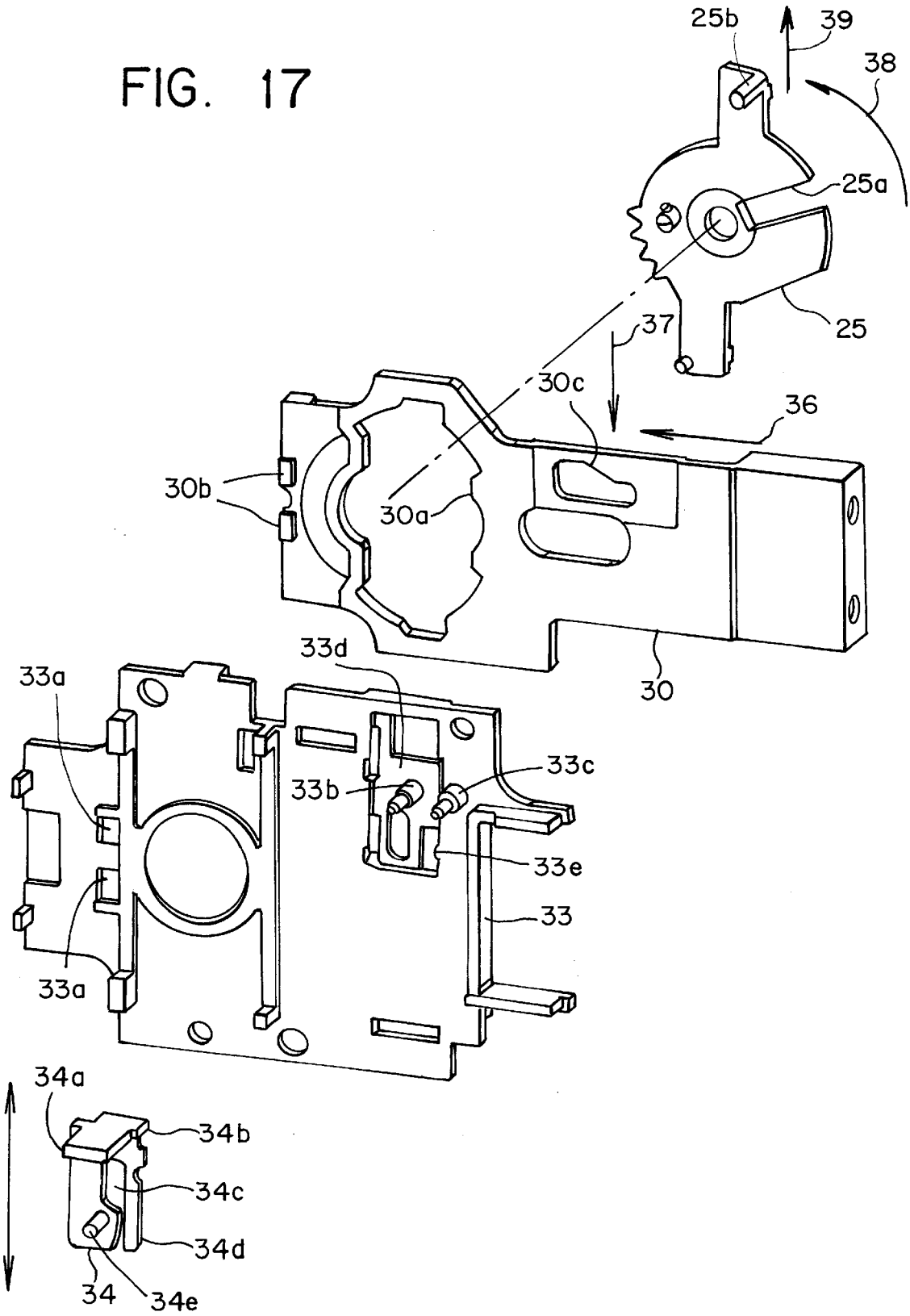

FIG. 17 is a perspective view of certain operating parts.

Figure 18:
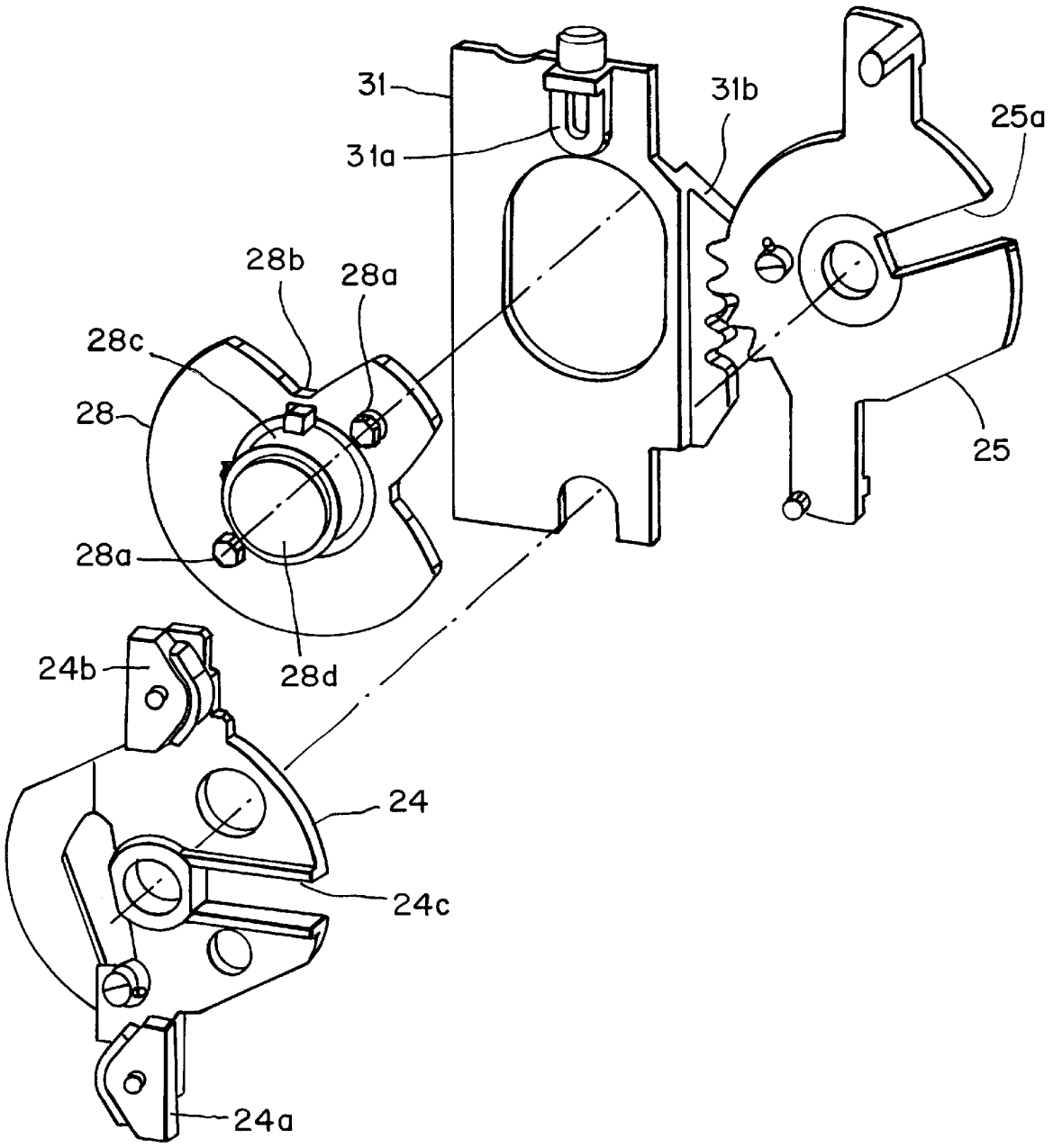

FIG. 18 shows the most important control elements by the same representation.

Figure 19:
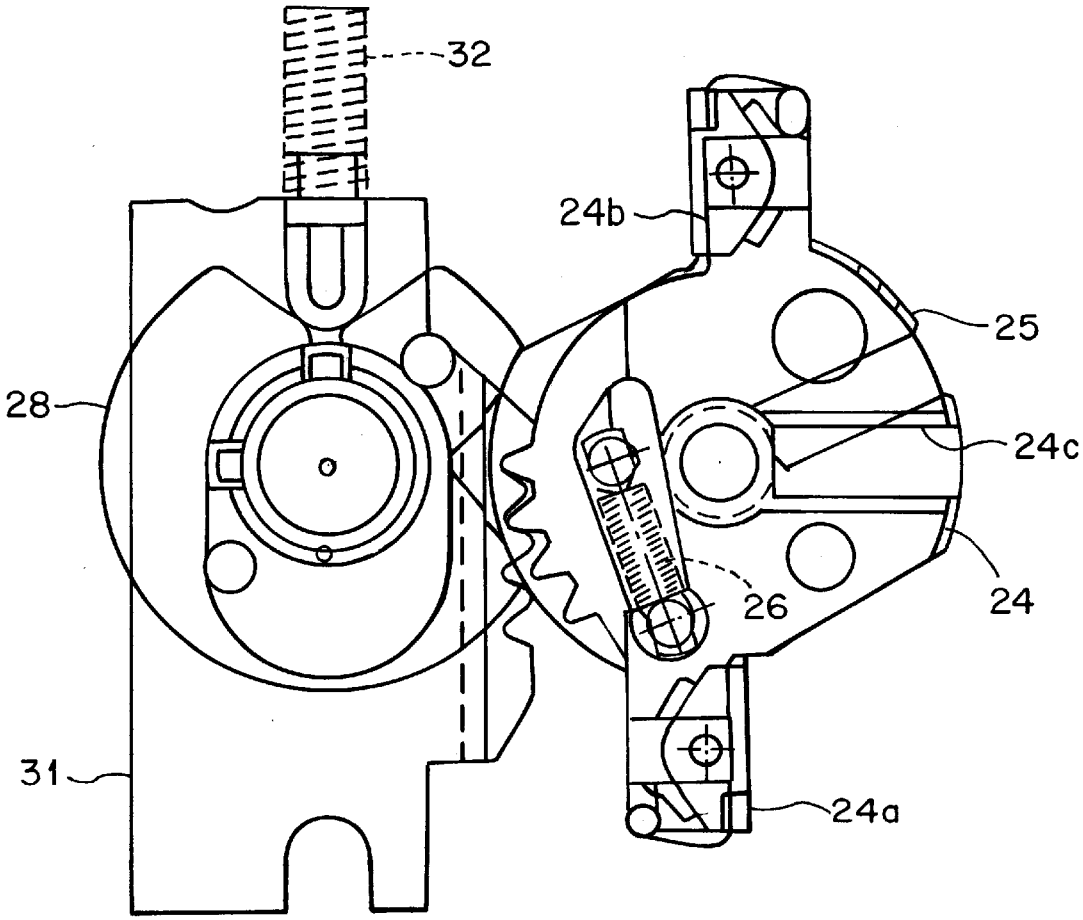

FIG. 19 is a side view of said control elements; and

Figure 20:
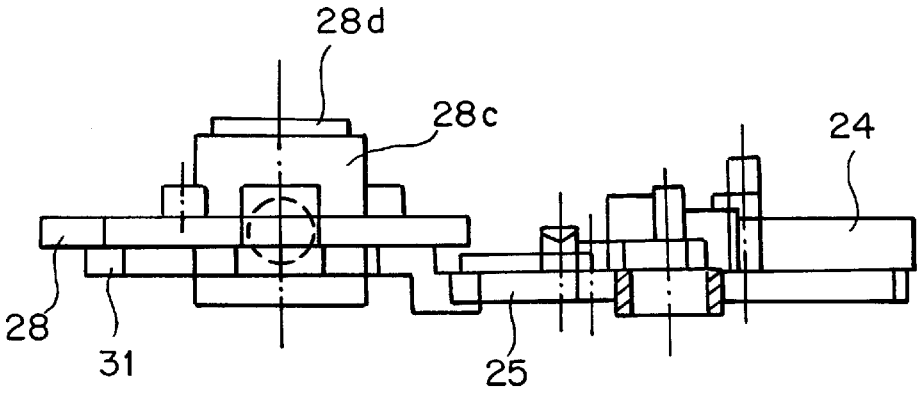

FIG. 20 is a top view of said components.

DETAILED DESCRIPTION OF THE DRAWING AND PREFERRED EMBODIMENTS

Figure 1:
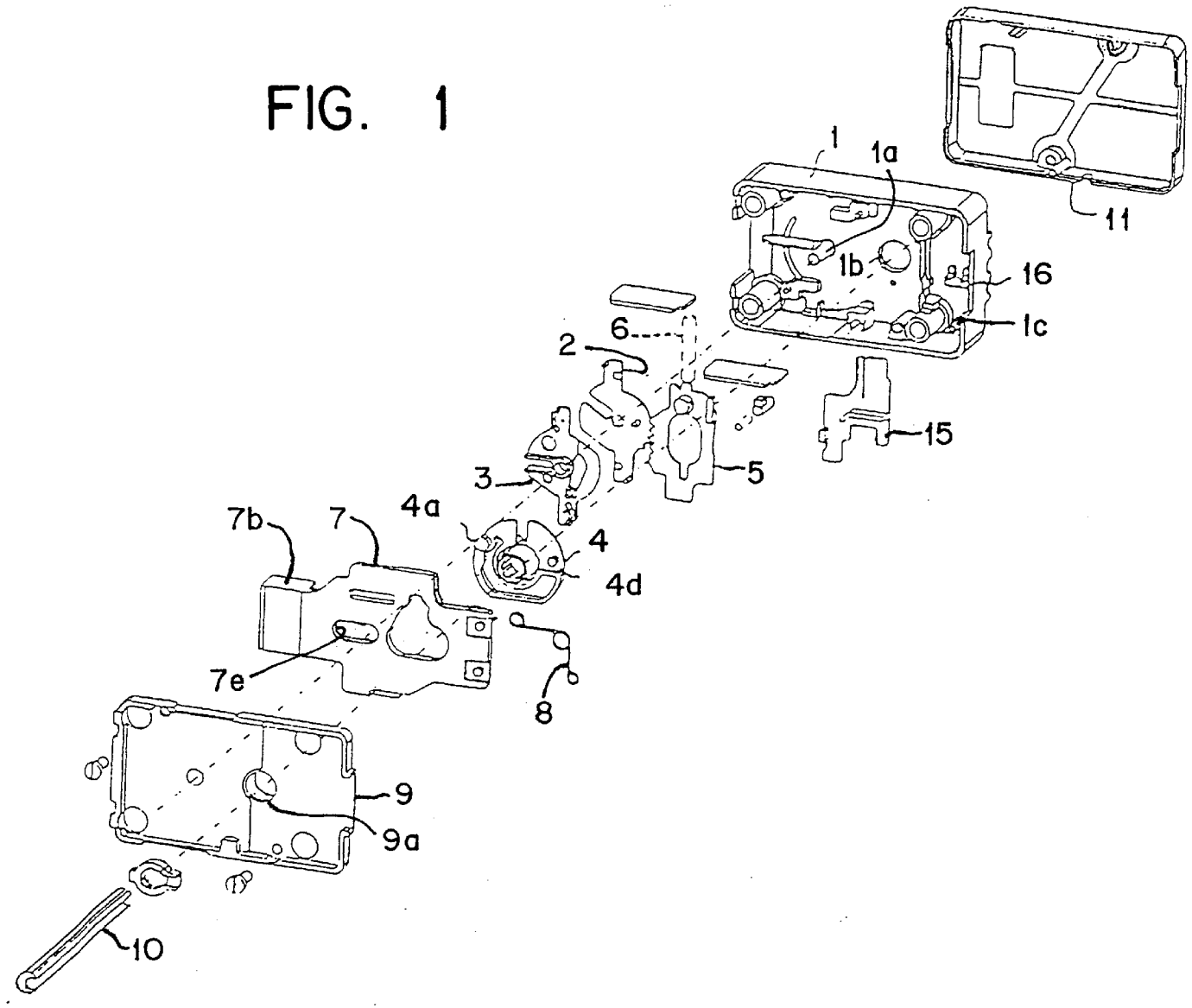
FIG. 1 represents the exploded parts of the lock.

In FIG. 1, reference numeral 1 denotes the housing, which has a bearing pin 1*a* and a bearing sleeve 1*b*, among other components. The pin 1*a* receives a blocking plate 2 and a control plate 3. A driving nut 4 is guided in the bearing sleeve 1*b*. A toothed slider 5 is arranged below the nut and is moved by the driving nut against the force of a spring 6. The nut 4 is located below the locking bar 7 and drives the latter by means of the pin 4*a*. The movement of the locking bar is supported by an elbow spring 8. Said spring engages a pin 4*d* of the nut 4. The second end is suspended on a pin 1*c* of the housing 1. As a so-called "above dead center" spring, it supports both the reaching of the blocking position and also of the open position of the driving nut 4. Undefined intermediate positions of the driving nut are avoided under the influence of the spring.

The components are kept together by a lock cover 9. A bearing sleeve 9*a* encloses the driving nut 4. Reference numeral 10 denotes a hollow drive shaft, which fits in a profiled opening of the drive nut and supports a handle not shown. Control lines can be installed, extending through said shaft. A second bottom plate 11 is shown behind the housing 1, said plate having an upright edge. A protected cavity is formed in this way on the back side of the housing, accommodating the control electronics of the lock.

Figure 2:
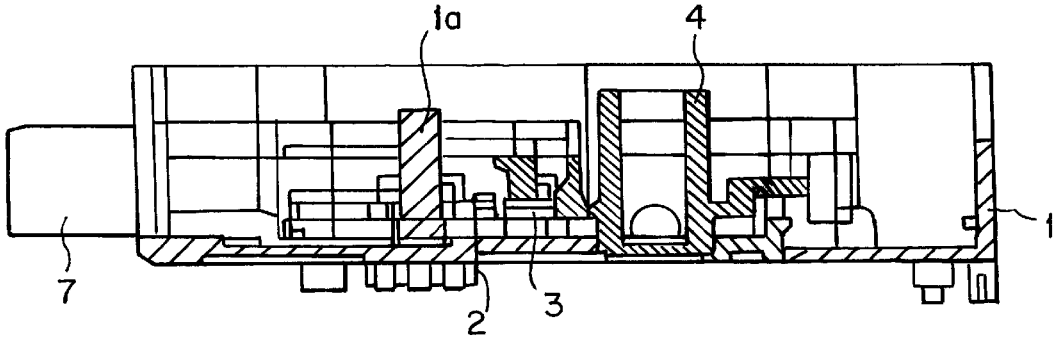
FIG. 2 is a longitudinal section along lock axis A-B.

FIG. 2 shows a longitudinal section along the lock axis A-B. The figure shows in the housing the bearing pin 1*a*, the plates 2 and 3, the driving nut 4 and the locking bar 7.

Figure 3:
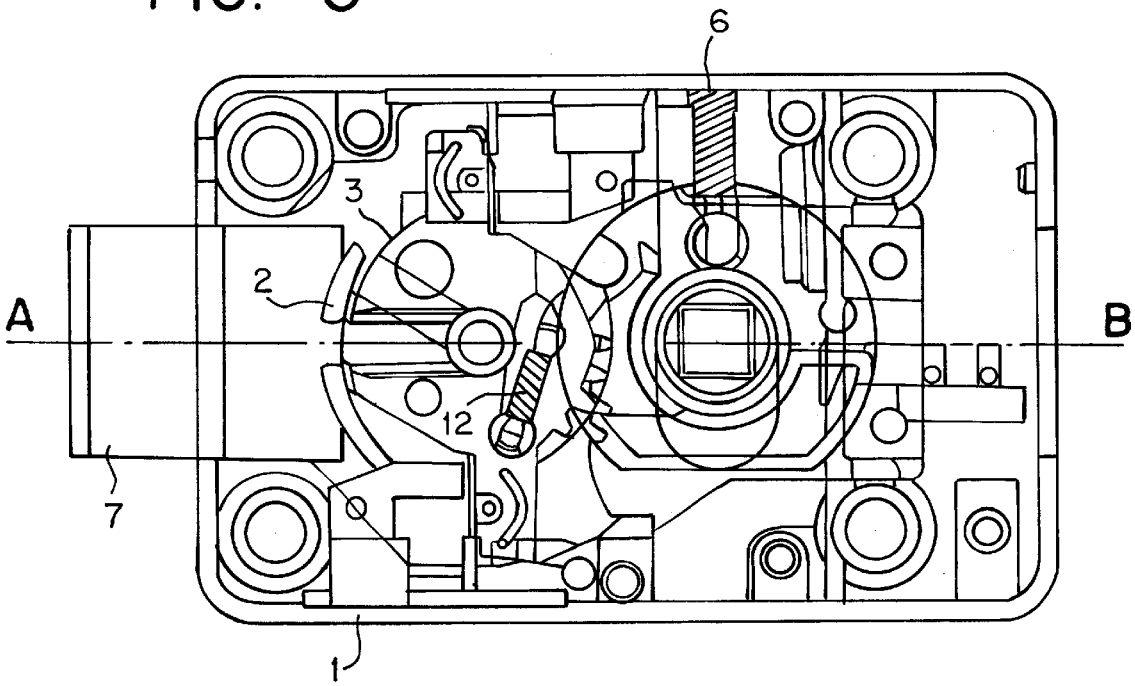
FIG. 3 is a top view of the open lock.

FIG. 3 shows that the blocking plate 2 and the control plate 3 are coupled by a spring 12.

Figure 4:
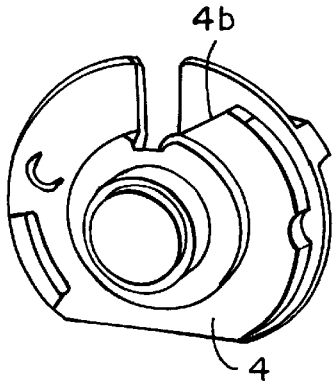
FIG. 4 shows a perspective view of the driving nut.

FIG. 4 shows the back side of the driving nut 4. The figure shows a control surface 4*b*, which moves the slider 5 shown in FIGS. 5 and 6 via the pin 5*a*.

The control elements are shown in exploded view in FIG. 5 in their blocking positions. In the resting position, the secant 4*c* of the driving nut 4 is disposed parallel to the lock axis A-B, and thus horizontally. When the driving nut 4 is turned clockwise by about 30 degrees, the slider 5 migrates upward and the blocking plate 2 turns to the left until its passage pin channel 2*a* is aligned with the lock axis A-B. Under the influence of the spring 12, the control plate 3 was pivoted to the left as well.

If none of the electromagnets 13 and 14 mounted on the housing is excited, none of the armatures 13*a*, 14*a* supported on the control plate 3 can be retained. Since the angle of adjustment between the passage pin channels 2*a* and 3*a* remains unchanged, the passage pin 7*e* of the locking bar is blocked.

The result is different according to FIG. 6. Due to the retaining current in one of the magnets 13 and 14, the control plate 3 stops, whereas the blocking plate 2 turns to the left under the expansion of the spring 12. Both passage pin channels are aligned with the lock axis A-B and the locking bar can be fully pulled back.

The control cam 7*a* of the locking bar 7 is designed in such a way that it will not be moved during the scanning motion of the driving nut 4. Thus the head 7*b* of the locking bar remains engaged in the closing plate over the entire length of the path of the locking bar until the opening process starts. Stated differently, driving nut 4, slider 5, blocking plate 2, and control plate 3 are all driven by drive shaft 10 in order to drive the blocking plate 2 and the control plate 3 into the opening position. (See, FIG. 6) Once the opening position has been reached, locking bar 7, and passage pin 7*e*, is also moved. Pin 4*a* of driving nut 4 therefore carries out an idle run on control cam 7*a* of the locking bar 7 before it drives the locking bar along. This idle run corresponds with the "lead angle" of driving nut 4.

FIGS. 5*a*, 5*b*, 5*c* and 6*a*, 6*b*, 6*c* show that in the opening position, the blocking plate 2 abuts the slider 5. The mechanical stop assures that the passage pin channel is exactly aligned when the passage pin 7*e* approaches the locking bar 7. The_mechanical stop occurs when the blocking plate 2 and the slider 5 come into contact with one another underneath the toothing, so that the angular position of the blocking plate 2 is exactly defined, i.e., the slot is precisely aligned with axis AB of the lock.

The exact opening position of the passage pin channel 3*a* is preset by the position of the electromagnets 13, 14. The blocking plate 2 is provided with the arms 2*b* and 2*c*, which support the pins 2*d* and 2*e*. Said pins take the control plate 3 back with them when, during a failed opening attempt, the handle is released and the slider 5 is pushed down by the spring 6.

Since the armatures 13*a* and 14*a* basically abut the yokes of the electromagnets 13 and 14, a very low retaining current suffices for safely actuating the lock.

Should one of the current circuits fail due to an error in the coil or feed line, the other magnet can take over its function. Therefore, it is highly unlikely that a safe-deposit box has to be forcefully opened due to failure of the lock.

FIGS. 7, 8 and 9 show how a switching slide 15 can be operated via the locking bar 7, which activates a microswitch for the closing message. The microswitch, which is not shown, is plugged onto the retaining pins 16 in the housing 1.

FIG. 7 shows the driving nut 4 and the switching slide 15 from the back. When the driving nut 4 is turned in the direction of the arrow 17, the slide 15 migrates upward in the direction of the arrow 18.

FIG. 8 shows the housing 1, the driving nut 4, the switching slide 15 and the locking bar 7 pulled apart. The switching slide 15 has a control surface 15*a*, which is impacted by a prong 7*c* of the locking bar 7.

FIG. 9 shows how the slide 15 is pushed down when the locking bar 7 is pulled back. The switching slide 15 is preferably comprised of an elastic material. Reference numeral 15*b* denotes a sprayed-on, rod-like spring.

FIG. 10 shows a relocking system for the described lock. The bottom plate 11 supports a pin 11*a*, by which a relocking element 19 is pushed up, guided in the housing 1 above the locking bar 7. A block-like projection 19*a* moves into the path of a blocking edge 7*d* of the locking bar 7 when the bottom plate 11 is knocked away.

The bottom plate 11, the housing 1, the locking bar 7 and the lock cover 9 are shown in the exploded view in FIG. 11. A spring 20 rests in the cover 9 and applies pressure to the part 19/19*a*.

FIG. 12 represents the relocking system in the condition of its normal function. With its blocking edge 7*d*, the locking bar 7 is capable of passing by the projection 19*a*.

FIG. 13 shows how the element 19, when the bottom plate 11 is removed, slips upward and the projection 19*a* blocks the locking bar 7.

FIG. 1 shows a hollow shaft 10, which is manufactured from a multi-wedge section, the latter fitting into a mating recess of the driving nut 4.

FIGS. 3, 5 and 6 show the driving nut 4 with a square recess as commonly found heretofore. Square shafts with through bores could be used as well for installing the control cables.

FIG. 14 shows another type of construction of an electromagnetically controllable safety lock.

The housing 21, which is preferably manufactured by the pressure casting process, has a bearing pin 21*b* in addition to fastening holes and a breakthrough 21*a*. The electromagnets 22 and 23, for controlling the lock are secured in the housing in such a way that they oppose the armatures of the control plate 24. Said control plate and a blocking plate 25 are pivot-mounted on the pin 21*b* with limited swivel motion. The components 24 and 25 are coupled with each other by a lightweight tension spring 26. A toothed driving shaft 27 engages frictionally a nut 28. A pin plate 29 is associated with said nut and the pin 29*a* of said pin plate acts on the control cam 30*a* of a locking bar 30. The nut 28 has the pins 28*a*, which alternatively fit into the pairs of holes 29*b* of the plate 29.

Reference numeral 31 denotes a slide, the cam 31*a* of which slides in a recess 28*b* of the nut 28. The slide is pushed down by a spring 32. The function of said slide is to move via its toothing 31*b* the blocking plate 25 until the passage pin channel 25*a* is disposed horizontally and aligned with the passage pin channel 24*c*.

Furthermore, the lock comprises an intermediate plate 33, on which a switching slide 34 can be seen, said slide being supported in a recess 33*d*, in which it is displaceable vertically.

The lock cover 35 keeps all described components together and protects them against external influences. A break cam 35*a* is worked into the cover on the extended axis of the driving shaft 27. The material is expected to yield at this site if the shaft 27 is forcefully driven inward in order to knock away the entire lock.

When the lock is installed, the driving shaft 27 ends in the nut 28, with its cylindrical attachment 28*c* sealed by a cover 28*d*. A break line is also provided between the attachment 28*c* and the cover 28*d*.

When a burglar hits the shaft 27, the nut 28 with the pin plate 29 is first driven against the locking bar 30. Within the zone of its control cam 30*a*, said locking bar is weakened to such an extent that it will bend. This will cause two projections 30*b*, which are provided on the left edge, to be forced into the recesses 33*a* of the intermediate plate 33. This will additionally arrest the locking bar and protect it against tampering.

If, with a sufficiently hard blow onto the driving shaft 27, the cover 28*d* is chipped away, the shaft 27 will advance until it reaches the lock cover 35. There, the metal sheet will be deformed within the zone of the break line, in a way such that it penetrates the latter, and any further application of force will be in vain.

The tearing forces at the sites of fracture are, in any case, dimensioned in such a way that they are distinctly lower than the retaining forces of fastening screws, which may be fitted into holes of the housing, as shown in FIG. 8. (The fastening screws themselves are not illustrated.)

The nut 28, the locking bar 30 and the intermediate plate 33 are shown enlarged in FIG. 15, so that details are more clearly visible. The nut 28 with the recess 28*b*, the cylindrical attachment 28*c* and the cover 28*d* can be produced by the deep-drawing process. The material of the locking bar 30 is intentionally weakened at the sites 30*a* 1 and 30*a*2 to such an extent that the left end of the locking bar, from where the protrusions 30*b* are projecting, can be bent. The protrusions 30*b* then enter the recesses 33*a* of the intermediate plate 33. Reference symbol 30*c* denotes a control slant.

FIG. 16 again shows the nut 28 with the pins 28*a*, the attachment 28*c* and the cover 28*d*. The locking bar 30 is displaceably supported in the housing between the nut 28 and the plate 33. When the locking bar 30 is deformed by blows to the nut 28, the projections 30*b* enter into the recesses 33*a* of the intermediate plate 33 and prevent the locking bar from retracting to the left.

FIG. 17 shows the blocking plate 25 with the passage pin 25*a* and the pin 25*b*. In addition to the control cam 30*a* and the projections 30*b*, the locking bar 30 has a control slant 30*c*.

Within the zone of the bolts 33*b*, 33*c*, the intermediate plate 33 shows a recess 33*d*, in which the switching slide 34 is supported and displaceable vertically. Said slide has a surface 34*a* at the top, which acts upon the microswitch not shown. The pin 25*b* engages the edge 34*b*. The bolt 33*b* penetrates through the oblong hole 34*c*. An elastic attachment 34*d*, together with a lug 33*e*, permits the switching slide 34 to assume two defined positions. A rear-side bolt 34*e* is acted upon by the control slant 30*c*.

The movements take place as follows: when the locking bar 30 is retracted in the direction of the arrow 36, the bolt 34*e* and thus the switching slide 34 are pressed down by the control slant 30*c* in the direction of the arrow 37. The microswitch secured on the bolts 33*b*, 33*c* responds, and the unlocking of the box can be signaled to a monitoring center.

When the locking bolt 30 is extended, this will at first have no influence on the switching slide 34. However, once the passage pin of the locking bar has left the channel 25*a*and the blocking plate 25 is folding back in the direction of the arrow 38, the switching slide 34 is pressed up by the pin 25*b* via the edge 34*b* in the direction indicated by the arrow 39.

This type of control of the switching slide and the microswitch has the exceptional advantage that the signal is available over the entire path of the locking bar, which means that the all-clear signal is given only when the safe has been safely locked and the passage pin channel has been blocked.

FIG. 18 shows an enlarged representation of how the nut 28 moves the slide 31 and how the latter moves the blocking plate 25.

The cam 31*a* is resting in the recess 28*b*. When the nut 28 is turned, the slide 31 migrates up and the blocking plate 25 is pivoted clockwise until its passage pin channel 25*a* is aligned with the channel 24*c* of the control plate 24.

FIG. 19 shows the interaction between the parts: the nut, the slide, the blocking plate and the control plate assume their blocking positions, in which the passage pin channels are blocked.

FIG. 20 shows a top view of the nut 28, the slide 31, the blocking plate 25 and the control plate 24.

When the driving shaft 27 is moved in the position shown in FIG. 19, the blocking plate 25 turns clockwise. If no opening pulse is applied, and the electromagnets 22, 23 are de-energized, the control plate 24 is pulled along by the spring 26. The armatures 24*a* and 24*b* lift off from the electromagnets; however, the passage pin channels remain closed. The opening attempt ends with the passage pin of the locking bar 30 impacting the pivoted control plate, whereby the locking bar can be moved only by millimeters. However, if an opening pulse is applied, the armatures 24*a* and 24*b* are retained by the electromagnets 22 and 23. The control plate 25 turns against the force of the lightweight spring 26 until the passage pin channel 25*a* is aligned with the channel 24*c*. The passage pin can now penetrate and the locking bar can be retracted.

Since all torques for the control processes and movements are applied manually, and the armatures rest against the electromagnets in their resting positions, no electrical lifting power is required. The magnets merely have to retain the control plate against the force of the weak spring 26. The electromagnets therefore can be designed very small, and the current consumption is extremely low.

Commercial Utility:

The types of embodiment of safety locks described above are excellently suited for application in large numbers of units in safety-box installations where their operating condition is monitored in a monitoring center by security personnel.

But they also can be used very well individually in money safes or cabinets for safeguarding valuable articles.

The release pulse can be transmitted via a keyboard or a card reader. If the safe-deposit boxes have additional keyholes, the opening pulse is usually triggered by the security personnel from a central control panel.

A locker equipped with the main lock and the control lock cannot be opened as long as the control lock is not provided with an opening pulse. Such lock combinations are commonly employed in safe-deposit box installations and in connection with lockers with a higher safety level that may only be opened jointly by two authorized persons.

List of Reference Numerals

1 Housing;
l*a* Bearing pin;
1*b* Bearing sleeve;
1*c* Pin;
2 Blocking plate;
2*a* Passage pin channel;
2*b*, 2*c* Arms;
2*d*, 2*e* Pins;
3 Control plate;
3*a* passage pin channel;
4 Driving nut;
4*a* Pin;
4*b* Control surface;
4*c* Secant,
5 slider;
5*a* Pin;
6 Spring;
7 Locking bar;
7*a* Control cam;
7*b* Head of locking bar;
7*c* Prong;
7*d* Blocking edge;
7*e* Passage Pin;
8 Lug spring;
9 Lock cover;
9*a* Bearing sleeve;
10 Driving shaft;
11 Bottom plate;
11*a* Pin;
12 Spring;
13, 14 Electromagnets
13*a*, 14*a* Armatures;
15 Switching slide;
15*a* Control surface;
15*b* Spring;
16 Retaining pins;
17, 18 Arrows;
19 Relocking element;
19*a* Block-like projection;
20 Spring;
21 Housing;
21*a* Breakthrough;
21*b* Bearing pin;
22, 23 Electromagnets;
24 Control plate;
24*a*, 24*b* Armatures;
24*c* Passage pin channel;
25 Blocking plate;
25*a* Passage pin channel;
25*b* Pin;
26 Tension spring;
27 Drive shaft;
28 Nut;
28*a* Pins;
28*b* Recess;
28*c* Cylindrical attachment;
28*d* Cover;
29 Pin plate;
29*a* Pins;
29*b* Pairs of holes;
30 Locking bar;
30*a* Control cam;
30*b* Projections;
30*c* Control slope;
31 Slide;
31*a* Cam;
31*b* Toothing;
32 Spring;
33 Intermediate plate;
33*a* Recesses;
33*b*, 33*c* Bolts;
33*d* Recesses;
33*e* Prong;
34 Switching slider;
34*a* Surface;
34*b* Edge;
34*c* Oblong hole;
34*d* Attachment;
34*e* Bolt;
35*a* Lock cover;
35*a* Fracture line;
36, 37, 38, 39 Arrows.

What is claimed is:

1. An electromagnetically controllable safety lock for containers for valuables, comprising a locking bar having a passage pin, and an electromagnet acting as a retaining magnet, said electromagnet blocking or releasing the retraction of the locking bar via controlling and blocking elements, wherein a driving nut moves a slider provided with teeth and driving along a blocking plate provide with a passage pin channel, said blocking plate being coupled via a spring with a control plate having an angularly offset passage pin channel, said control plate supporting an armature, said armature being retained by the electromagnet when current is applied, causing both channels to be aligned with the lock axis and permitting the passage pin with the locking bar to pass.

2. The safety lock according to claim 1, wherein the locking bar is constructed to be moved by a handle via said driving nut.

3. The safety lock according to claim 1, wherein the control plate supports a second armature, said second armature being opposed by a second electromagnet in a housing for the lock.

4. The safety according to claim 1, wherein a control cam for the locking bar is constructed so that the lead angle of the driving nut required for scanning does not trigger a movement of the locking bar.

5. The safety lock according to claim 1, further comprising a switching slide supported in a housing for the lock for actuating a microswitch, said switching slide being pressed down by a prong when the locking bar is retracted, and being lifted by the driving nut when the locking bar is extended.

6. The safety lock according to claim 1, further comprising a relocking element arranged between a lock cover and a bottom plate, said relocking element blocking the locking bar via a projection and a blocking edge when the bottom plate is knocked away.

7. The safety lock according to claim 1, wherein for obtaining a relocking function, the locking bar has weak points in the region of a control recess, said weak points yielding when blows are struck to a drive shaft, causing projections of the locking bar to engage recesses of an intermediate plate, thereby securing mechanical blockage of the locking bar.

8. The safety lock according to claim 1, further comprising a lock cover having a fracture line, the fracture line breaking open if blows are administered to a drive shaft, permitting the shaft to pass through, and thereby preventing the lock from being knocked off.

9. The safety lock according to claim 1, wherein for actuating a microswitch, provision is made for a switching slide, said switching slide being supported on an intermediate plate so that when the locking bar is retracted, said switching slide is activated via a control slope, and reset by a pin of the blocking plate, only after the locking bar has again been fully extended.

* * * * *